US011267039B2

(12) United States Patent
Yang

(10) Patent No.: US 11,267,039 B2
(45) Date of Patent: Mar. 8, 2022

(54) TRIAXIAL SPRING-MAKING MACHINE AND METHOD THEREOF

(71) Applicant: PLUSPRINGS MACHINERY CO., LTD, New Taipei (TW)

(72) Inventor: Ching-Fa Yang, New Taipei (TW)

(73) Assignee: PLUSPRINGS MACHINERY CO., LTD, New Taipei (TW)

( * ) Notice: Subject to any disclaimer, the term of this patent is extended or adjusted under 35 U.S.C. 154(b) by 84 days.

(21) Appl. No.: 16/704,296

(22) Filed: Dec. 5, 2019

(65) Prior Publication Data

US 2020/0360983 A1 Nov. 19, 2020

(30) Foreign Application Priority Data

May 16, 2019 (TW) ..... 108206104

(51) Int. Cl.
*B21F 35/00* (2006.01)
*B21F 23/00* (2006.01)
*B21F 3/02* (2006.01)

(52) U.S. Cl.
CPC ..... *B21F 35/00* (2013.01); *B21F 23/00* (2013.01); *B21F 3/02* (2013.01)

(58) Field of Classification Search
CPC ..... B21F 35/00; B21F 35/003; B21F 35/006; B21F 35/02; B21F 35/04; B21F 3/00; B21F 3/02; B21F 3/027; B21F 3/04; B21F 3/06; B21F 3/08; B21F 3/10; B21F 3/12
See application file for complete search history.

(56) References Cited

U.S. PATENT DOCUMENTS 9,796,013 B1 * 10/2017 Yang ..... B21F 1/008 72/137
2002/0108420 A1 * 8/2002 Itaya ..... B21F 35/00 72/137
2011/0114217 A1 * 5/2011 Wu ..... B21F 35/00 140/71 C
2016/0332212 A1 * 11/2016 Yang ..... B21F 1/008 72/137
2017/0203435 A1 * 7/2017 Yang ..... B21F 3/02 72/137
2018/0065169 A1 * 3/2018 Kang ..... B21F 3/02 72/137

FOREIGN PATENT DOCUMENTS

JP 5710086 B1 * 4/2015 ..... B21F 3/06

* cited by examiner

*Primary Examiner* — Adam J Eiseman
*Assistant Examiner* — Matthew Stephens
(74) *Attorney, Agent, or Firm* — Locke Lord LLP; Tim Tingkang Xia, Esq.

(57) ABSTRACT

A method for making spring includes providing a wire at a working plane by a wire feeding machine; shaping the wire by a first working tool based on a first structure for the spring; and shaping the wire by a second working tool based on a second structure for the spring. In particular, the first working tool and the second working tool are configured to be movable in a reversed-reciprocation way along a direction perpendicular to the working plane.

7 Claims, 6 Drawing Sheets

TRIAXIAL SPRING-MAKING MACHINE AND METHOD THEREOF

CROSS-REFERENCE TO RELATED APPLICATIONS

This non-provisional application claims priority under 35 U.S.C. § 119(a) on Patent Application No(s). 108206104 filed in Taiwan, R.O.C. on May 16, 2019, the entire contents of which are hereby incorporated by reference.

BACKGROUND OF THE INVENTION

Field of the Invention

The present invention relates to a spring-making machine, and more particularly to a triaxial spring-making machine and a method thereof.

Description of the Prior Art

Nowadays, assembly of the parts of a spring-making machine is mainly contingent upon the type of spring to be shaped; a plurality of processing tools are decided according to the spring type and mounted on the base respectively. Generally, spring-making machines use cams as a means to drive the processing tools, so that they will cooperate with each other in the process of manufacturing springs. However, current designs of the base in these machines limit the possible purchase orders that a spring-making machine can manage. For example, as far as the assembly of different parts of an existing spring-making machine is considered, the spatial arrangement of processing tools in the machine is basically designed based on the type of spring to be shaped. Generally, the processing tools do not have a modular design and are arranged in an approximately radial manner to point to a wire guide member. In addition, using a fixed program to arrange the movements of spring processing tools on the base makes an existing spring-making machine to be able to produce one type of spring only. Once there are demands for making different types of springs, the processing tools configured on existing spring-making machines need to be redesigned. When the complexity of a spring structure increases or when mixed types of springs need to be processed and manufactured, the number of processing tools to be used will increase. In consequence, it would not be easy to arrange the mounting locations for the processing tools in order to allow them to operate in a movable working space (including horizontal and vertical movement) without interfering with one another. This will remain a difficult problem for existing spring-making machines. Therefore, using existing spring-making machines is disadvantageous to manufacturing processes that involve multiple types of springs in small quantities or mixed types of springs.

In view of the above, to enhance the efficiency and convenience in using spring-making machines, there exists a need to develop improved spring-making machines and related production methods.

SUMMARY OF THE INVENTION

The object of the present invention is to provides a working tool device adaptive for a spring making-machine, including a main body having a mounting portion, a first side and a second side, the first side and the second side extending from the mounting portion; a first movable member located on the first side and coupled to the main body such that the first movable member is able to move reciprocally along a first direction relative to the main body; and a second movable member located on the second side and coupled to the main body such that the second movable member is able to move reciprocally along a second direction relative to the main body; wherein the first direction and the second direction are parallel, wherein the first movable member and the second movable member are configure to move synchronously but in opposite directions.

In one preferred embodiment, the first movable member and the second movable member provide a first mounting surface and a second mounting surface, respectively, for installing at least two working tools on the first side and the second side of the main body.

In one preferred embodiment, the main body has a top portion extending from the mounting portion and is partially covered by a first shoulder portion of the first movable member and a second shoulder portion of the second movable member, wherein the first shoulder portion and the second shoulder portion provide a third mounting surface and a fourth surface, respectively, for installing at least two working tools.

In one preferred embodiment, the main body has a top portion extending from the mounting portion and is partially covered by a first shoulder portion of the first movable member and a second shoulder portion of the second movable member, wherein the first shoulder portion and the second shoulder portion provide a third mounting surface and a fourth surface, respectively, for installing at least two working tools, wherein a distance between the first mounting surface and the second surface is larger than a distance between the third mounting surface and the fourth mounting surface.

In one preferred embodiment, the first movable member and the second movable member are coupled via a transmission device which enables the first movable member and the second movable member are able to move reciprocally and synchronously in opposite directions.

In one preferred embodiment, the main body has a rotary, the first movable member has a first rack, the second movable member has a second rack, the first rack and the second rack face to each other, the rotary engages with the first rack and the second rack so that the first rack and the second rack are simultaneously pushed as the rotary started.

In one preferred embodiment, the first side and the second side of the main body provide guide rails, respectively, for connecting the first movable member and the second movable member, wherein the main body has openings at the first side and the second side, respectively, for receiving the first rack of the first movable member and the second rack of the second movable member.

Another object of the present invention is to provides a spring-making machine, including a panel providing a working plane; a wire feeding machine mounted to the panel for delivering wire for shaping spring; and at least one movable assembly. Said assembly includes a first platform movably connected to the working plane of the panel so that the first platform is reciprocally movable along a first direction relatively to the panel; a second platform movably connected to the first platform so that the second platform is reciprocally movable along a second direction relatively to the panel; a main body optionally mounted on the second platform; and a first movable member and a second movable member movably coupled to the main body so that the first movable member and the second movable member are reciprocally movable along a third direction relatively to the panel, wherein the first movable member and the second movable member respectively provides a mounting surface for installing at least one working tool, and thereby the at least one working tool is movable along said three directions relatively to the working plane of the panel.

In one preferred embodiment, the first movable member and the second movable member are configured to move synchronously in opposite directions.

In one preferred embodiment, the first direction, the second direction and the third direction are orthogonal to each other.

In one preferred embodiment, the first movable member the second movable member are coupled via a transmission device so that the first movable member and the second movable member are synchronously and reciprocally movable in opposite directions.

In one preferred embodiment, the main body has a rotary, the first movable member has a first rack, the second movable member has a second rack, the first rack faces to the second rack, the rotary engages with the first rack and the second rack so that the first rack and the second rack are simultaneously pushed as the rotary started.

Further object of the present invention is to provides a method of spring manufacture for shaping a spring, including continuously delivering, by a wire feeding machine, a wire toward a working plane; shaping, by a first working tool, the wire based on a first structure of the spring; and shaping, by a second working tool, the wire based on a second structure of the spring. The first working tool and the second working tool are configured to move synchronously and reciprocally along opposite directions vertical to the working plane.

In one preferred embodiment, a working tool device includes a main body having a first side and a second side, wherein the first side and the second side are perpendicular to the working plane; a first movable member located on the first side and movably coupled to the main body; and a second movable member located on the second side and movably coupled to the main body. The first working tool and the second working tool are mounted to the first movable member and the second movable member, respectively.

In one preferred embodiment, the working tool device cooperates with a first platform and a second platform to form a triaxial moving mechanism, wherein the first platform movably connects to the working plane, the second platform movably connects to the first platform, and the main body of the working tool device mounted to the second platform.

In one preferred embodiment, the method further includes moving, by a triaxial moving mechanism, the first movable member along a direction perpendicular to the working plane to a working position of the wire to shaping the first structure; and moving, by the triaxial moving mechanism, the second movable member along the direction perpendicular to the working plane to the working position of the wire to shaping the second structure.

DETAILED DESCRIPTION OF THE PREFERRED EMBODIMENTS

The following description will explain the present invention more fully with reference to the appended drawings, and will show certain embodiments by way of examples. However, the subject matter of the present invention may be embodied in various forms, and the present invention shall not be limited by any exemplary embodiments disclosed herein. The embodiments described herein are for exemplary purposes only. Similarly, the present invention shall be construed in a reasonably broad manner. In addition, as the subject matter of the present invention may be embodied as a method, device or system, the embodiments described herein may include examples in the form of hardware, software, firmware or any combination thereof (but excluding software-only scenarios).

The phrase "in one embodiment" as used herein does not necessarily refer to the same embodiment being described. Similarly, the phrase "in another embodiment" does not necessarily refer to a different embodiment from the one being described. The claimed subject matter may include all the elements described in an exemplary embodiment, or a combination of part of the elements described in an exemplary embodiment.

Figure 1:
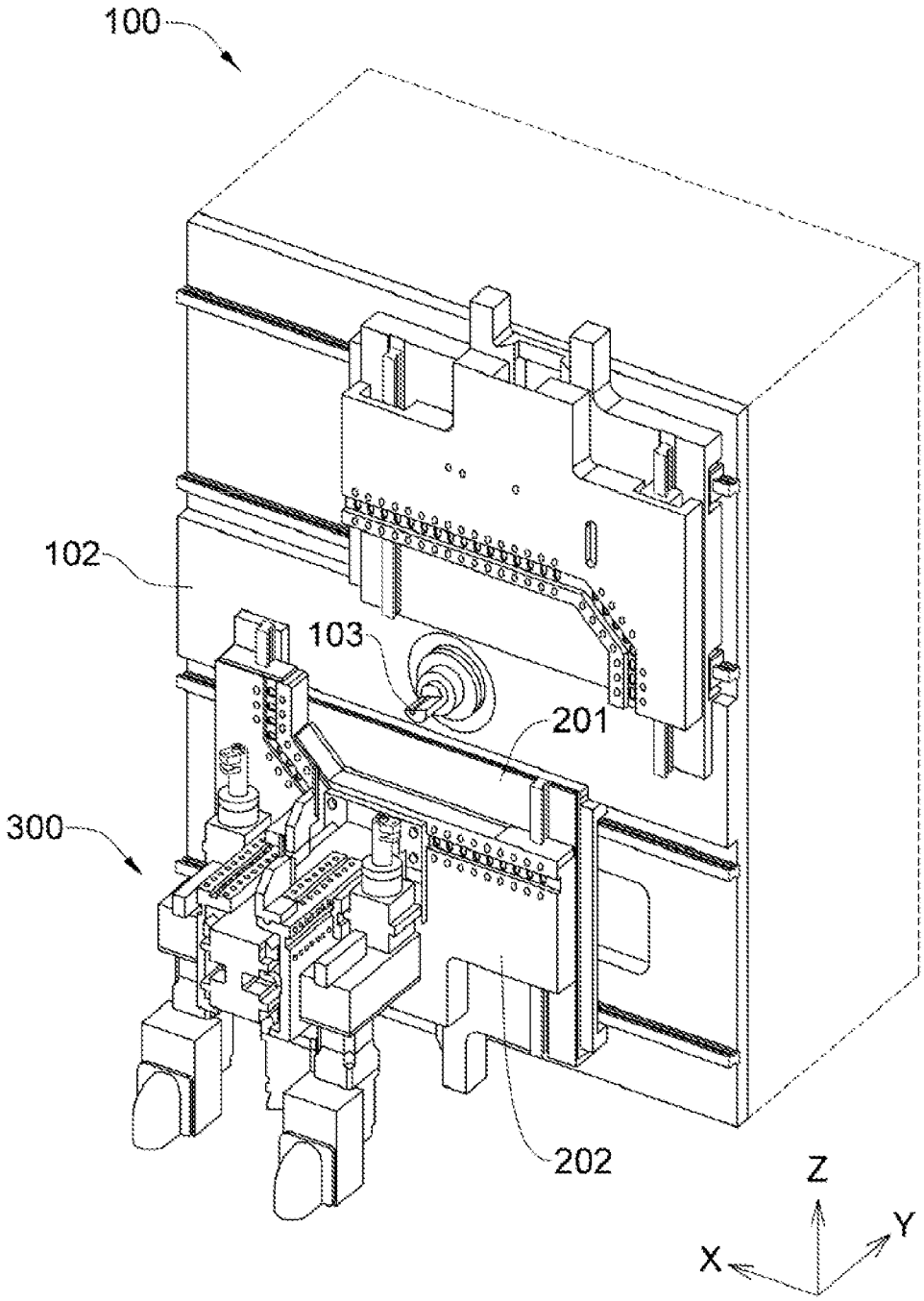
FIG. 1 is a perspective view of a spring-making machine according to one embodiment of the present invention.

FIG. 1 illustrates an embodiment of a spring-making machine 100 according to the present invention. FIG. 1 focuses on certain part of the spring-making machine only, and some other parts of the machine are illustrated in dotted lines or not shown. The spring-making machine 100 comprises a panel 101 located at one side of the machine. The panel 101 is provided with a working plane 102, which is a main area for shaping springs. A wire feeding machine 103 is mounted to the panel 101 and is configured to supply wires that are to be processed on the working plane 102. For example, the wire feeding machine 103 may feed wire continuously along a direction perpendicular to the working plane 102.

One or more movable assemblies can be arranged on the working plane 102 of the panel 101. As FIG. 1 shows, two movable assemblies are located respectively on the upper half and lower half of the working plane 102, and the movable assemblies partially surround the wire feeding machine 103 located at the center of the working plane 102. The following description will take the movable assembly located on the lower half as an example to provide further details. The movable assembly comprises a first platform 201 and a second platform 202. The first platform 201 is movably coupled to the working plane 102, such that the first platform 201 is able to make a reciprocating motion with respect to the panel 101 along a first direction (e.g., the X direction as shown in FIG. 1). The second platform 202 is movably coupled to the first platform 201, such that the second platform 202 is able to make a reciprocating motion with respect to the panel 101 along a second direction (e.g., the Z direction as shown in FIG. 1). A movable connection between components, as described above, can be achieved by means of guide rails, which is a known technique in the field. The movable assemblies shall comprise drive units, though not explicitly illustrated in the drawings, to achieve automatic control of the machine. As FIG. 1 shows, the second platform 202 is provided with a mounting surface for one or more working tools or devices to be mounted thereon.

To achieve 3-axis operations of the spring-making machine, the present invention provides a working tool device 300 mounted onto the second platform 202. The working tool device 300 allows operations to be performed in yet another direction (e.g., the Y direction as shown in FIG. 1), other than the first direction and the second direction. Also, the switching of working tools can be achieved with the working tool device 300. Basically, the one or more working tools for shaping spring are mounted onto the working tool device 300, such that the working tools are able to move along three axes with respect to the panel 101 or the wire feeding machine 103.

Figure 3:
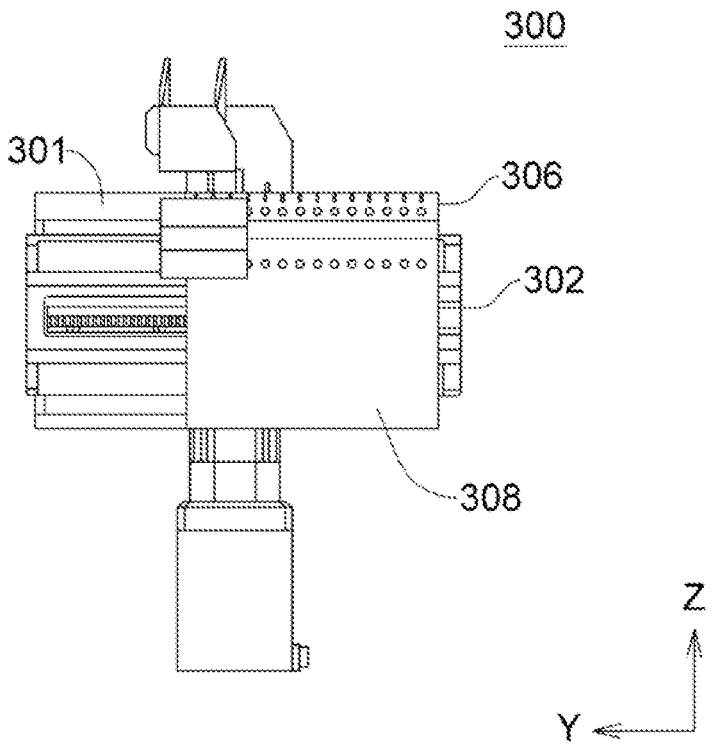
FIG. 3 is a side view of a working tool device according to the present invention.
Figure 4:
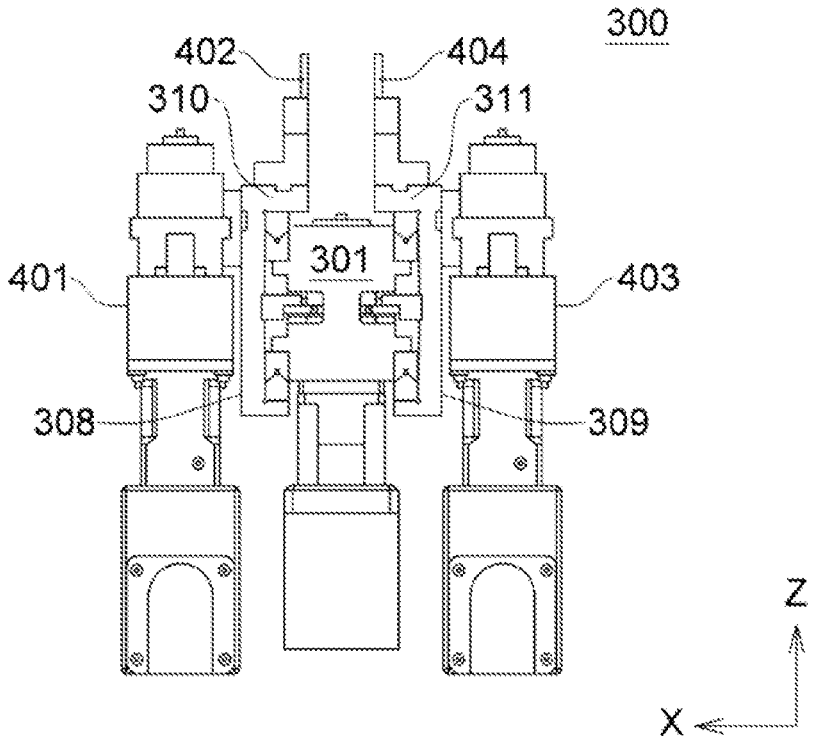
FIG. 4 is a front view of a working tool device according to the present invention.
Figure 5:
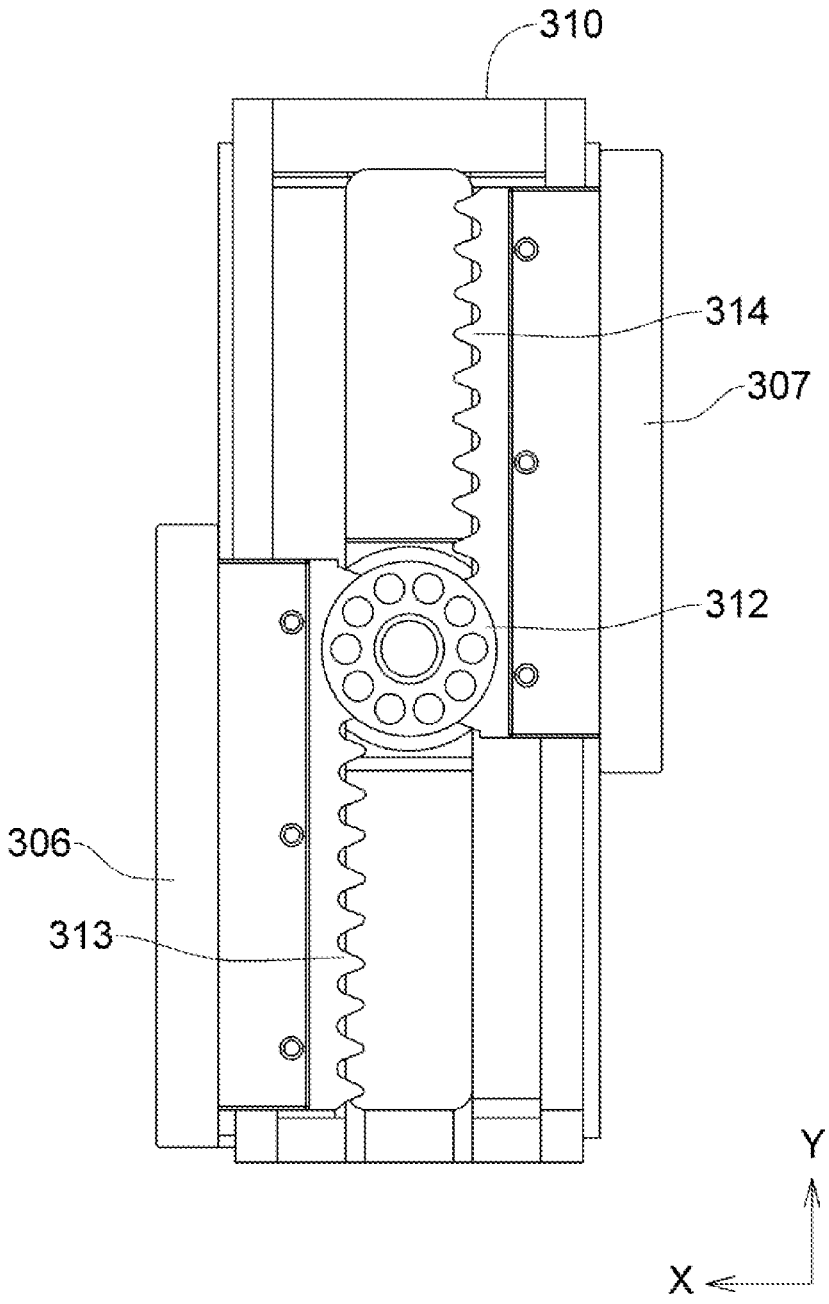
FIG. 5 is a cross-sectional view of a working tool device according to the present invention.

FIGS. 3, 4 and 5 show different views of the working tool device 300. The working tool device 300 comprises a main body 301 having an end portion 302, a mounting portion 303, a first side 304, and a second side 305. The end portion 302 and the mounting portion 303 are opposite to each other. The first side 304 and the second side 305 are opposite to each other, extending between the end portion 302 and the mounting portion 303. In this embodiment, the main body 301 is essentially of a rectangular structure, and the mounting portion 303 includes a mechanism adapted for installing the main body 301 to the second platform 202. The mounting portion 303 can be secured to the second platform 202 by a conventional means. The end portion 302 is basically a free end that does not connect to other structures. The first side 304 and the second side 305 are parallel and opposite to each other, both perpendicular to the X direction. In other words, the first side 304 and the second side 305 are parallel to the XZ-plane. The main body 301 is a housing for accommodating a movable mechanism, which enables the working tool device to operate. As shown in the drawings, a driver that drives the working tool device to operate can be located under the main body 301, so that the driver will not interfere with the shaping of springs.

A first movable member 306 is located at the first side 304 and movably coupled to the main body 301. The first movable member 306 is configured to make a reciprocating motion with respect to the main body 301 along a first direction. A second movable member 307 is located at the second side 305 and movably coupled to the main body 301. The second movable member 307 is configured to make a reciprocating motion with respect to the main body 301 along a second direction. Also, the first movable member 306 and the second movable member 307 are configured to move synchronously but in opposite directions. The first and second directions described in this paragraph related to the movement of the working tool device differ from the first and second directions described earlier related to the movement of the platforms. In particular, the first and second directions described in this paragraph are parallel to each other but in opposite directions, as will be further discussed below.

The first movable member 306 and the second movable member 307 have similar structures. The first movable member 306 and the second movable member 307 are provided with a first mounting surface 308 and a second mounting surface 309, respectively, for mounting at least two working tool assemblies onto the first side 304 and the second side 305 of the main body 301. As shown in FIG. 3, the first mounting surface 308 of the first movable member 306 includes a plurality of holes and grooves for mounting working tool assemblies. In this embodiment, the holes and grooves for mounting working tool assemblies are arranged and extending in the Y direction; the moving range of the working tool assemblies along the Y direction is thus defined.

Figure 2:
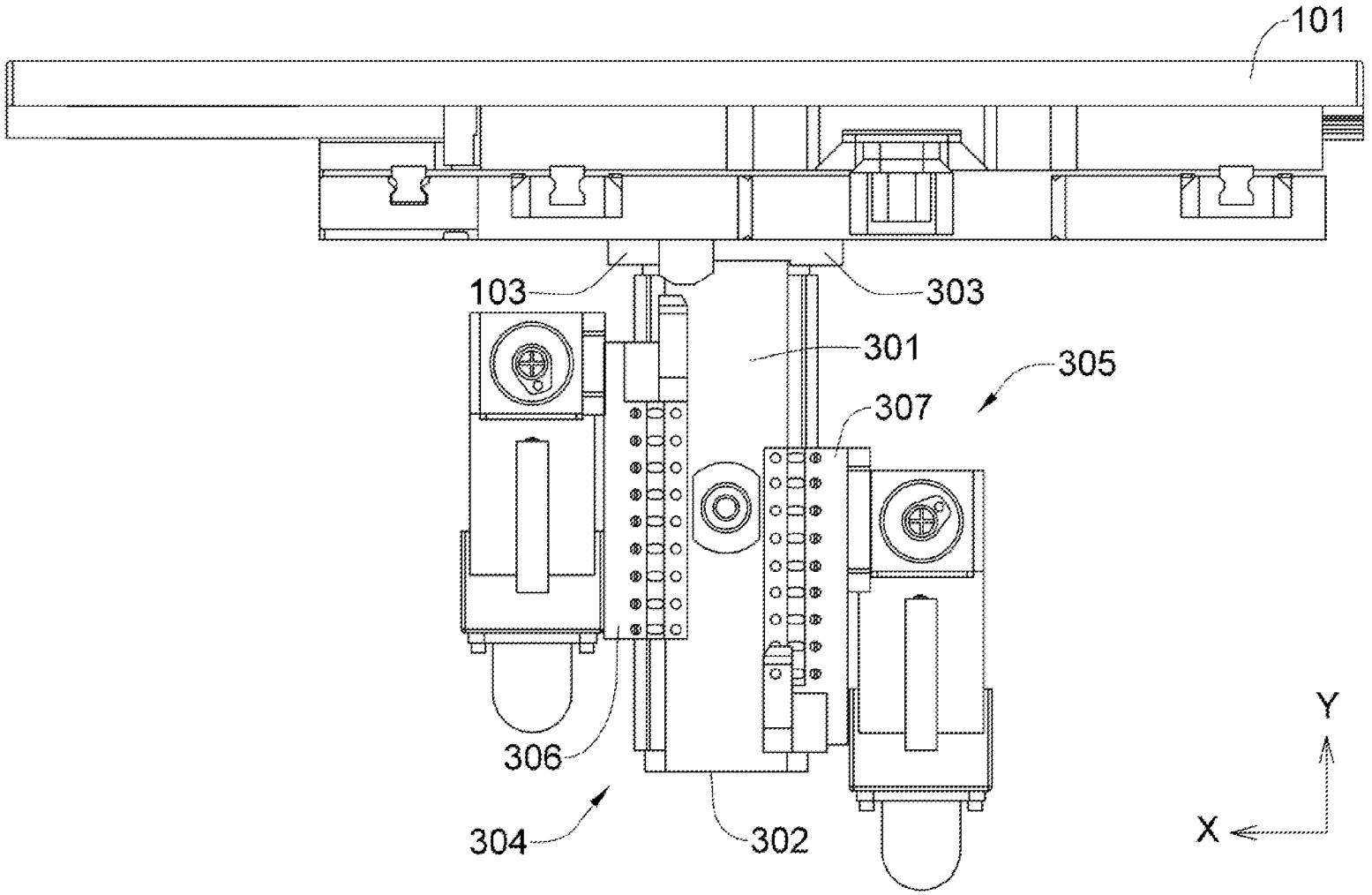
FIG. 2 is a top view of the spring-making machine illustrated in FIG. 1.

As shown in FIG. 4, the first movable member 306 and the second movable member 307 further include a first shoulder portion 310 and a second shoulder portion 311, respectively. The first shoulder portion 310 and the second shoulder portion 311 extend respectively from the first side 304 and the second side 305 toward a top portion (not labeled) of the main body 301, and cover the top portion of the main body 301 in part. As shown in FIG. 2, the first shoulder portion 310 and the second shoulder portion 311 are further provided with a third mounting surface (not labeled) and a fourth mounting surface (not labeled), respectively, for mounting at least two working tool assemblies. Similarly, the third and fourth mounting surfaces include a plurality of holes and grooves for mounting working tool assemblies. The first mounting surface and the third mounting surface of the first movable member 306 are perpendicular to each other; and the second mounting surface and the fourth mounting surface of the second movable member 307 are perpendicular to each other. Moreover, the distance between the first mounting surface and the second mounting surface is greater than the distance between the third mounting surface and the fourth mounting surface. As a result, the working tool assemblies will not interfere with one another when they are mounted onto these surfaces.

FIG. 1 and FIG. 4 show a state where certain working tool assemblies are mounted to the machine. As shown in these drawings, a first working tool assembly 401 is mounted to the first mounting surface 308 of the first movable member 306; a second working tool assembly 402 is mounted to the first shoulder portion 310 of the same. Moreover, a third working tool assembly 403 is mounted to the second mounting surface 309 of the second movable member 307; a fourth working tool assembly 404 is mounted to the second shoulder portion 311 of the same. In this embodiment, the first working tool assembly 401 and the third working tool assembly 403 are active working tools, meaning that they need to be controlled by a driver. By contrast, the second working tool assembly 402 and the fourth working tool assembly 404 are passive working tools, meaning that they do not need the control of a driver. As described above, the drivers can be arranged under the main body 301. It should be noted that there may be other combinations of working tool assemblies in addition to the combination as illustrated in the drawings.

FIG. 4 shows that the first movable member 306 and the second movable member 307 are slidably connected to the main body 301 by means of guide rails. The inner side of the first movable member 306 is provided with a pair of structures corresponding to the guide rails (not labeled) located on the main body 301, and the pair of structures are configured to restrain the first movable member 306 from moving in the X and Z directions. Thus, the first movable member 306 can move along the Y direction only. The second movable member 307 also has similar configurations. In other embodiments, the slidable connection may be alternatively achieved by a combination of wheels and rails.

The first movable member 306 and the second movable member 307 are coupled via a transmission device, such that the first movable member 306 and the second movable member 307 can make reciprocating motions synchronously in opposite directions. FIG. 5 is a top cross-sectional view showing the main body 301 and a transmission device mentioned above. A rotary 312 is securely accommodated in the main body 310 and configured to rotate along the XY-plane. The rotary 312 is connected to a driver as described above, which drives the rotary 312 to rotate in a clockwise or counterclockwise direction. FIG. 5 also shows that the first movable member 306 comprises a first rack 313 and the second movable member 307 comprises a second rack 314. The first rack 313 and the second rack 314 are secured to the inner sides of the first movable member 306 and the second movable member 307, respectively, and extend along the Y direction. The first rack 313 and the second rack 314 are opposite to each other and clamp the rotary 312 together. The rotary 312 is configured to engage with the first and second racks 313, 314; thus, when the rotary 312 rotates, it drives the first rack 313 and the second rack 314 to move synchronously in opposite directions. The rotary may be similar to a gear. In this embodiment, the first rack 313 and the second rack 314 are configured to move on a path along the Y direction, such that when one of the movable members reaches a termination point on the path along the Y direction, the other movable member reaches an opposite termination point on the path along the Y direction. As a result, a greatest distance between two working tools will be presented. In other embodiments, one or more rotaries may be used to drive the racks.

Based on the configurations described above, there will be a smallest distance and a greatest distance between the first movable member 306 and the second movable member 307 in accordance with the rotation of the rotary 312. In one embodiment, when one of the movable members moves from the mounting portion 303 of the main body 301 towards its end portion 302 (or otherwise), the other movable member will move, in an opposite direction, closer towards said movable member until the two of them have a smallest distance from each other; that is, the two movable members are located at a same position along the Y direction (e.g., around the middle part of the main body). After that, said movable member moves in an opposite direction until the two movable members have a greatest distance from each other; that is, the first movable member 306 and the second movable member 307 are located at two opposite termination points of the path of movement. In other words, the movable members 306 and 307 basically become in a front-rear relationship along the Y direction, except when they are in positions that have the smallest distance. As FIG. 2 shows, when one of the movable members moves relatively closer to the wire feeding machine 103 on the panel 101, said movable member enters a working position. The working position is a position where the working tool is able to contact the feed wire.

FIGS. 3 and 4 show that the main body 301 has one opening (not labeled) at each of its two sides. The openings are configured to allow the racks 313, 314 of the respective movable members 306, 307 to enter the main body 301 and engage with the rotary 312. The length of the openings in the Y direction determines the moving range of the movable members 306, 307. The openings can extend to the end portion 302 of the main body 301; as a result, the movable members 306, 307 can be detached from the main body 301 at the end portion 302, which would allow easier replacement or maintenance of the components. In other embodiments, the transmission device may be achieved using other mechanisms, such as gears and belts.

Based on the configurations described above, a spring-making machine according to the present invention can perform a method comprising the following steps to achieve fast switching of the working tools. Performing the method below does not require resetting the positions of the working tools, and thus, the machine can work in a more efficient way.

To make one or more types of springs, first, use the wire feeding machine 103 to continuously supply a wire. An inputting part of the wire feeding machine is connected to a wire guide device and a wire bundle. The wire feeding machine can be configured to dispense the wire continuously at a predetermined speed, or to dispense a predetermined length of the wire in a predetermined cycle.

Figure 6:
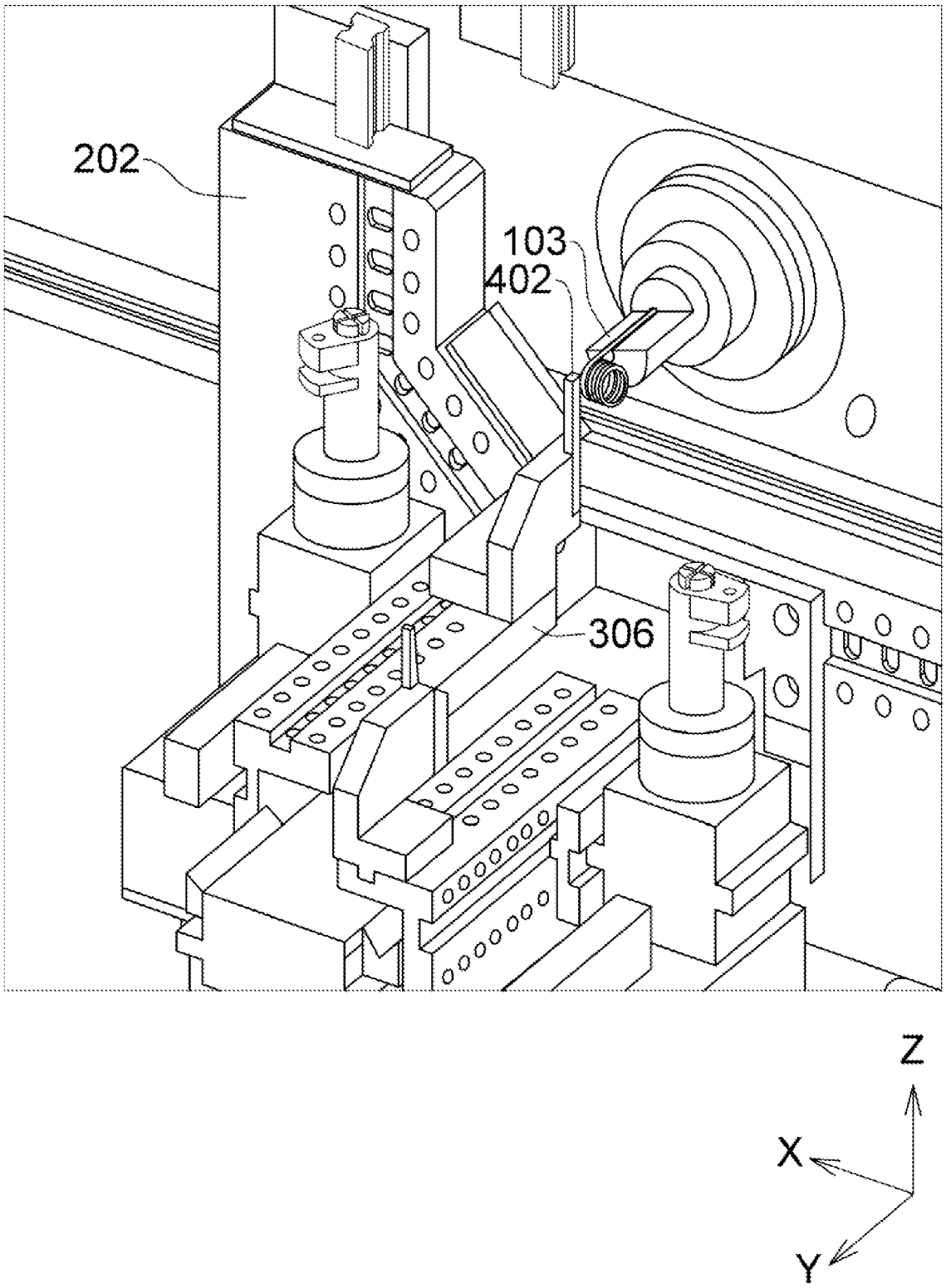
FIG. 6 shows a spring-making machine according to the present invention in a working state.

Next, use a first working tool to shape the wire based on a first structure of a spring to be shaped. As FIG. 6 shows, allow the first platform (not shown) and the second platform 202 to move to proper positions, and allow the first movable member 306 of the working tool device to move close to the wire feeding machine 103. As a result, the first working tool mounted to the first movable member 306 can enter a wire working position. The first working tool described here refers to the second working tool assembly 402 described above. Moreover, the first working tool is a wire winder, which shapes the wire into a spiral structure before the first working tool retreats from the working position or the dispensing of the wire is stopped.

Figure 7:
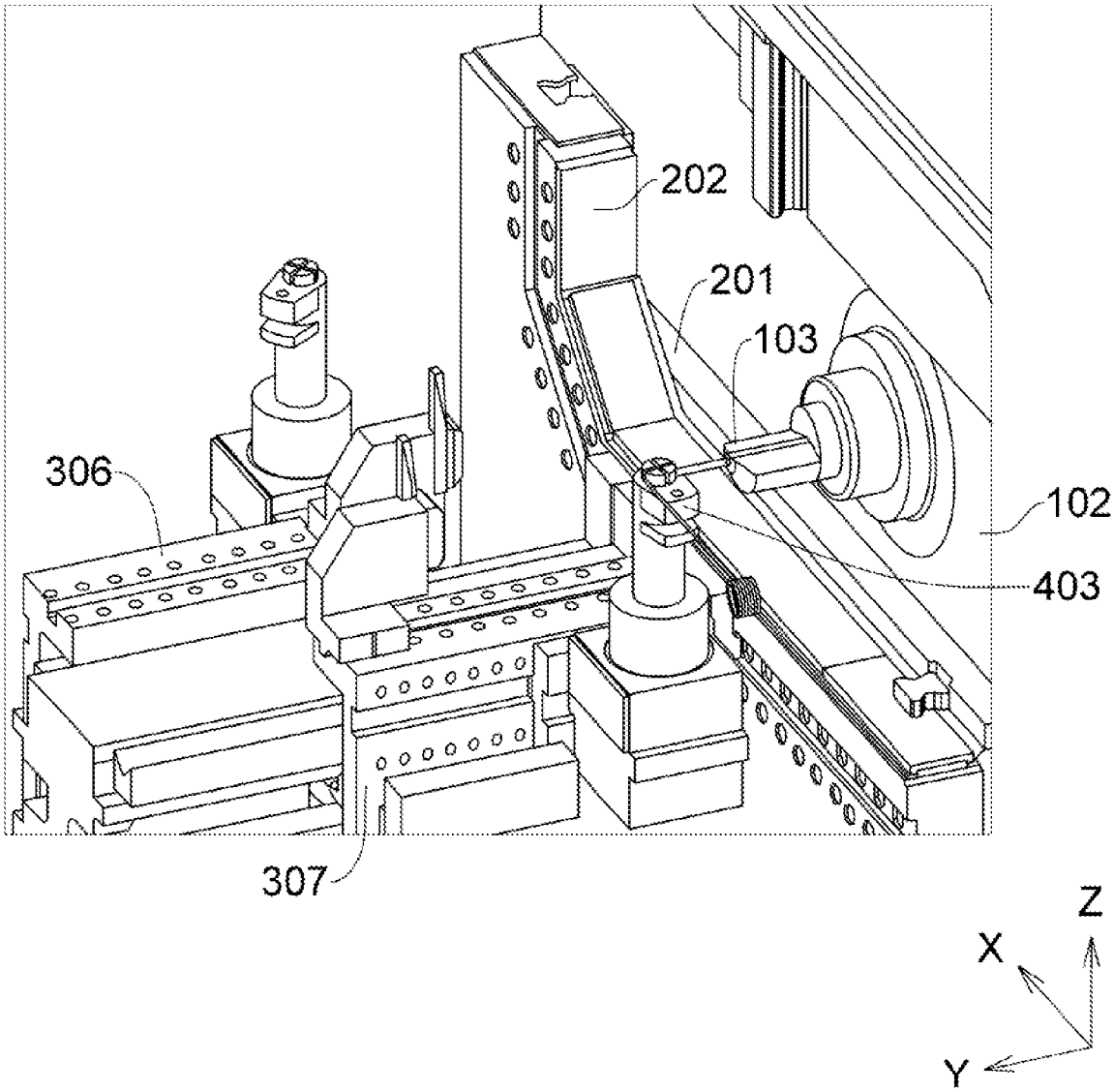
FIG. 7 shows a spring-making machine according to the present invention in another working state.

After the first structure (in this embodiment, a spiral structure) is shaped, use a second working tool to shape the wire based on a second structure of the spring to be shaped. This means a switch from using the first working tool to using the second working tool is carried out. As FIG. 7 shows, allow the first platform 201 and the second platform 202 to move to proper positions, and let the first movable member 306 of the working tool device move away from the working plane 102. This synchronously causes the second movable member 307 to move closer to the working plane 102 and allows the second movable member 307 to enter the wire working position. The second working tool described here refers to the third working tool assembly 403 described above. Moreover, the second working tool is a bending tool, which creates at least one bend for the wire before the second working tool retreats from the working position or the dispensing of the wire is stopped.

It should be understood that the working positions related to the first working tool and the second working tool may be the same or different depending on the machine configurations. As shown in the drawings, the working tool device in the illustrated embodiment is provided with four working tools mounted thereon. In other words, at least four working tools can be involved in the shaping of the springs in this embodiment. Those skilled in the art may, based on the design of a spring, determine the number and type of working tools to be mounted on the working tool device, as well as the relevant working scheme for those tools.

It should be noted that, as the first working tool and the second working tool are configured to make reciprocating motions synchronously in opposite directions along a direction (the Y direction) perpendicular to the working plane, the spring-making machine can easily achieve the switching of working tools without causing the working tools to be concentrated on the panel 101. Accordingly, a higher utilization rate within the area of the panel 101 can also be achieved. The movable assembly located on the upper half of the machine shown in FIG. 1 may be equipped with or replaced by a cutting tool for cutting the shaped spring from the wire. It should be understood that the positions for mounting the working tool devices are not limited to those illustrated in the drawings.

Based on the above descriptions, it is clear that compared with conventional spring-making machines, the spring-making machine according to the present invention further provides an axial movement mechanism that allows working tools to move in a direction perpendicular to the working plane. Thus, the arrangements of the working tools are not restricted to the plane where the panel is located (the XZ-plane). Moreover, the working tool devices according to the present invention provides a mechanism for making reciprocating motions in opposite directions, thus allowing the switching of working tools to be performed more easily. According to the present invention, at least four working tools can be mounted onto the working tool device, and those working tools can be freely switched. Compared with prior art spring-making machines, the spring-making machine according to the present invention has significantly improved usability.

The above description of various embodiments as provided concerning the claimed subject matter is for explanation and illustration purposes only, and is not intended to be comprehensive or limit the claimed subject matter to certain exact forms. One skilled in the art will readily appreciate that various modifications and variations of the present invention are possible. Specifically, although the systems or methods described above use "components" to explain the embodiments, such components may be replaced with other types, methods, interfaces, modules, models or any suitable equivalents. The embodiments are selected and described to best illustrate the subject of the present invention and the applications thereof, so that persons in related technical fields can understand the claimed subject matter, the various embodiments and improvements suitable for the specific use as contemplated.

What is claimed is:

1. A working tool device adaptive for a spring making-machine, comprising:

a main body having a mounting portion, a first side and a second side, the first side and the second side extending from the mounting portion;

a first movable member located on the first side and coupled to the main body such that the first movable member is able to move reciprocally along a first direction relative to the main body; and a second movable member located on the second side and coupled to the main body such that the second movable member is able to move reciprocally along a second direction relative to the main body;

wherein the first direction and the second direction are parallel, wherein the first movable member and the second movable member are configured to move synchronously but in opposite directions, wherein the main body has a rotary, the first movable member has a first rack, the second movable member has a second rack, the first rack and the second rack face to each other, the rotary engages with the first rack and the second rack so that the first rack and the second rack are simultaneously pushed as the rotary started.

2. The working tool device as claimed in claim 1, wherein the first movable member and the second movable member provide a first mounting surface and a second mounting surface, respectively, for installing at least one working tool on each of the first side and the second side of the main body.

3. The working tool device as claimed in claim 1, wherein the main body has a top portion extending from the mounting portion and is partially covered by a first shoulder portion of the first movable member and a second shoulder portion of the second movable member, wherein the first shoulder portion and the second shoulder portion provide a third mounting surface and a fourth surface, respectively, for installing at least one working tool on each of the third and fourth mounting surfaces.

4. The working tool device as claimed in claim 2, wherein the main body has a top portion extending from the mounting portion and is partially covered by a first shoulder portion of the first movable member and a second shoulder portion of the second movable member, wherein the first shoulder portion and the second shoulder portion provide a third mounting surface and a fourth surface, respectively, for installing at least one working tool on each of the third and fourth mounting surfaces, wherein a distance between the first mounting surface and the second surface is larger than a distance between the third mounting surface and the fourth mounting surface.

5. The working tool device as claimed in claim 1, wherein the first movable member and the second movable member are coupled via a transmission device which enables the first movable member and the second movable member to move reciprocally and synchronously in opposite directions.

6. The working tool device as claimed in claim 1, wherein the first side and the second side of the main body provide guide rails, respectively, for connecting the first movable member and the second movable member, wherein the main body has openings at the first side and the second side, respectively, for receiving the first rack of the first movable member and the second rack of the second movable member.

7. A spring-making machine including a working tool device as claimed in claim 1 mounted thereon, the spring-making machine comprising:

a panel providing a working plane;

a wire feeding machine mounted to the panel for delivering wire for shaping spring; and at least one movable assembly comprising:

a first platform movably connected to the working plane of the panel so that the first platform is reciprocally movable along a third direction relatively to the panel; and a second platform movably connected to the first platform so that the second platform is reciprocally movable along a fourth direction relatively to the panel;

wherein the main body is detachably mounted on the second platform, the first movable member and the second movable member movably coupled to the main body so that the first movable member and the second movable member are reciprocally and respectively movable along the first direction and the second direction relatively to the panel, the first direction and the second direction are orthogonal to the third direction and the fourth direction, such that the working tools mounted on the first movable member and the second movable member are movable along said directions relatively to the working plane of the panel so as to achieve a triaxial spring-making process.

* * * * *